US006505550B2

(12) United States Patent
Hamilton

(10) Patent No.: US 6,505,550 B2
(45) Date of Patent: Jan. 14, 2003

(54) COMPACTION METHODS AND APPARATUS

(76) Inventor: Robin Hamilton, Ashton Close Farm, Snelston, Ashbourne, Derbyshire DE6 2DL (GB)

( * ) Notice: Subject to any disclaimer, the term of this patent is extended or adjusted under 35 U.S.C. 154(b) by 0 days.

(21) Appl. No.: 09/851,647

(22) Filed: May 9, 2001

(65) Prior Publication Data

US 2001/0017328 A1 Aug. 30, 2001

Related U.S. Application Data

(62) Division of application No. 09/254,331, filed on May 3, 1999, now Pat. No. 6,247,662.

(30) Foreign Application Priority Data

Sep. 5, 1996 (GB) ..... 9618465

(51) Int. Cl.[7] ..... B02C 19/22

(52) U.S. Cl. ..... 100/148; 241/33; 241/100; 241/260.1

(58) Field of Search ..... 241/DIG. 30, 260.1, 241/100, 33; 100/147, 148, 50

(56) References Cited

U.S. PATENT DOCUMENTS

| | | | | |
|---|---|---|---|---|
| 1,353,420 A | | 9/1920 | Rene et al. | |
| 3,009,659 A | * | 11/1961 | Jones | 241/DIG. 30 |
| 3,065,689 A | | 11/1962 | Gueytron | |
| 3,866,529 A | | 2/1975 | Holman | |
| 3,889,588 A | | 6/1975 | Wollersheim | |
| 4,256,035 A | | 3/1981 | Neufeldt | |
| 4,415,336 A | | 11/1983 | Stasi et al. | |
| 4,852,817 A | * | 8/1989 | Tipton | 241/260.1 |
| 5,611,290 A | | 3/1997 | Tratz et al. | |

FOREIGN PATENT DOCUMENTS

| | | |
|---|---|---|
| DE | 656 535 | 1/1938 |
| DE | 1660 047 A | 10/1971 |
| DE | 25 06 042 A1 | 8/1976 |
| DE | 43 26 483 A1 | 2/1995 |
| EP | 0 019 538 A1 | 11/1980 |
| EP | 0 359 295 | 3/1990 |
| EP | 0 554 964 A1 | 8/1993 |
| FR | 2 263 099 | 10/1975 |
| FR | 2 265 635 A | 10/1975 |
| FR | 2527 139 | 11/1983 |
| WO | WO 94 07688 | 4/1994 |

* cited by examiner

*Primary Examiner*—Mark Rosenbaum
(74) *Attorney, Agent, or Firm*—Adams, Schwartz & Evans, P.A.

(57) ABSTRACT

Waste compaction apparatus has a screw conveyor which conveys material along a passage toward an exit nozzle which constricts the flow, to cause compaction. The screw conveyor is slidably mounted on a shaft, biased toward the nozzle. This allows the screw conveyor to move axially during compaction to help remove or avoid blockages within the apparatus.

15 Claims, 6 Drawing Sheets

COMPACTION METHODS AND APPARATUS

This application is a division of patent application Ser. No. 09/254,331, which issued as U.S. Pat. No. 6,247,662 B1 on May 3, 1999. This application claims the priority date of Sep. 5, 1996 for Great Britain Patent Application No. 9618465.0.

The present invention relates to compaction methods and compaction apparatus and in particular but not exclusively to methods and apparatus for compacting (i.e. compressing) waste material. Other applications for the invention include the compaction of waste materials used in farming and the food industry, but not necessarily waste materials.

Compacting apparatus is described in International Patent Application No. WO 94/07688. That apparatus uses a hopper to supply material to a screw conveyor which conveys material through a passage to cause compaction. The compacted material then leaves through an exit nozzle. A control circuit is provided to sense when the compacting apparatus becomes blocked. When this happens, the screw conveyor is reversed to draw compacted material back to the hopper, with a view to clearing the blockage. It has been found that even if this technique for clearing blockages is effective, its reliance on a potentially complex and expensive control arrangement can prevent its use for certain commercial applications, particularly with relatively small, cheap compacting apparatus. The present inventor has therefore sought to provide improved compacting apparatus.

SUMMARY OF THE INVENTION

The present invention provides compacting apparatus comprising a screw conveyor for axial rotation to convey material through a passage and compact it therein, and an exit nozzle communicating with the passage, the screw conveyor being supported for axial movement relative to the passage during use, whereby the screw conveyor may move axially in the event of a blockage.

The screw conveyor is preferably resiliently biased in the axial direction relative to the passage. The screw conveyor may be biased to move relative to the passage in the conveying direction. At least part of the screw conveyor is preferably located within a tapering part of the passage and has a diameter which tapers in the same sense, whereby axial movement of the screw conveyor relative to the passage varies the gap between the tapering part of the screw and the tapering part of the passage. The tapering parts of the screw conveyor and passage may have substantially the same degree of taper.

Preferably fixed blade means are located adjacent the screw conveyor, and cooperating blade means are carried by the screw conveyor, whereby material located between the said blade means is subjected to a cutting action by continued rotation of the screw conveyor. The cooperating blade means may be located along the outer edge of the flight of the screw conveyor. The cooperating blade means may extend over a greater axial length of the screw conveyor than the fixed blade means, whereby the blade means remain in cooperation over a range of positions of the screw conveyor relative to the passage. Preferably at least part of the cooperating blade means are located along a tapering portion of the screw conveyor.

In a second aspect, the invention provides compacting apparatus comprising a screw conveyor for conveying waste material through a passage and compacting it therein, and an exit nozzle communicating with the passage, the nozzle defining an internal transverse cross-sectional area which enlarges and reduces respectively in response to increasing and decreasing material pressure, and wherein the nozzle comprises at least one resilient member which causes the nozzle to be biased toward a position of minimum cross-sectional area, the or at least one resilient member comprising an inflatable portion which provides an adjustable degree of resilience dependent upon the degree of inflation of the resilient portion.

Preferably the nozzle has a plurality of wall portions which are movable relative to each other to vary the cross-sectional area of the nozzle, the resilient member cooperating with the wall portions to bias the nozzle toward a position of minimum cross-sectional area.

The nozzle may comprise a number of spaced apart, longitudinally extending fingers. Preferably there are no gaps between the fingers and the nozzle tapers towards its outlet when the nozzle cross-sectional area is at its minimum. The nozzle may comprise two members each of which has a number of spaced apart, longitudinally extending fingers, one member being arranged inside the other. The resilient member may be located to surround the outer of the two members to provide resilient bias thereto. Preferably the two members are arranged such that a finger of one member overlaps two fingers of the other member whereby there are substantially no gaps between the fingers.

In another aspect, the invention provides material handling apparatus comprising compacting means operable to compact material and to deliver compacted material to collection means, the collection means providing a plurality of locations at which compacted material may be received, and being movable to allow one location to move to an emptying position while another is moving to a position for receiving material from the compacting means.

The collection means may comprise a rotatable carousel. Each location may be adapted to removably receive a receptacle which can be removed when full for replacement by an empty receptacle. The receptacle may be a bag or bin liner.

Preferably the apparatus comprises means operable to detect the weight of material received at a location and to cause the collection means to move when the received weight exceeds a threshold value.

Preferably the compacting means comprises a screw conveyor which has a substantially vertical orientation to drive compacted material up to a position from which the material may fall to the collection means.

BRIEF DESCRIPTION OF THE DRAWINGS

Embodiments of the present invention will now be described in more detail, by way of example only, and with reference to the accompanying drawings, in which.

DESCRIPTION OF THE PREFERRED EMBODIMENT AND BEST MODE

Figures 1, 1A:
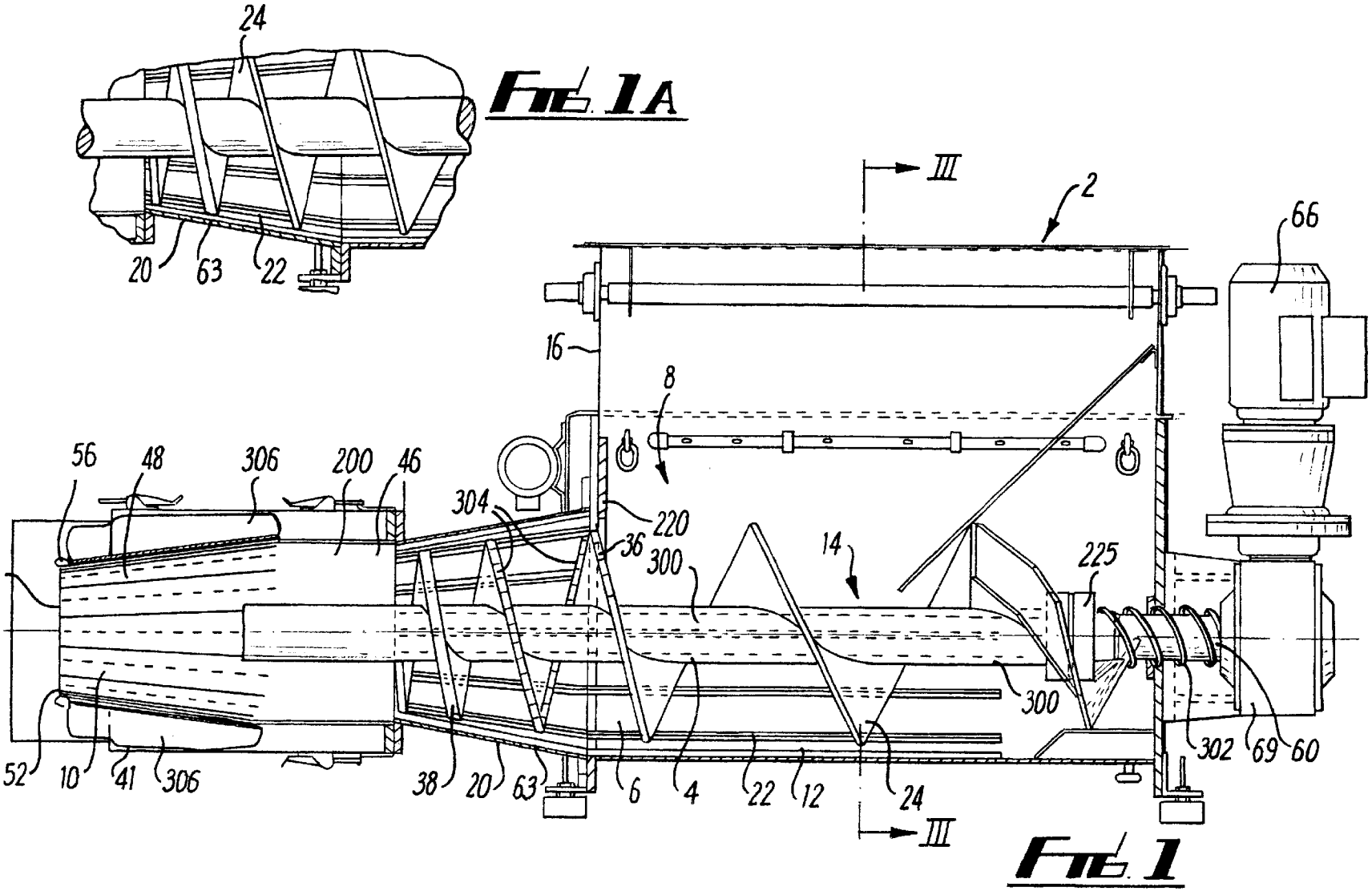
FIG. 1 shows a longitudinal cross-sectional view of a compactor.
FIG. 1*a* shows an enlarged view of pat of the compactor of FIG. 1.

As can be seen from FIGS. 1 to 7, the waste compaction apparatus 2 has a screw conveyor 4 which conveys as well as compacts material along a passage 6 from an inlet 8 to an exit nozzle 10.

The passage 6 is generally cylindrical and has a first part 12 of generally uniform cross-section. The first part 12 of the passage has a longitudinally extending opening 14 through which uncompacted waste material is fed from the hopper 16. The size of the hopper 16 is selected so as to prevent over-filling of the apparatus. In practice, this first part 12 is in the form of a trough having a rounded bottom 18 (see FIG. 3), the sides of which also define the hopper 16. The trough opening defines the longitudinally extending opening 14.

The passage 6 also has a second part 20 which is tapered in the direction towards the exit nozzle. This second part 20 thus has a generally frusto-conical shape.

The inner walls of the passage 6, both in the first part 12 and the second part 20 are provided with longitudinally extending ribs 22 which project inwardly into the passage. These ribs 22 prevent partially compacted material from rotating with the screw conveyor 4.

The inner walls of the first part 12 of the passage are provided with two projections 230 (see FIG. 3) which extend along its length. These two projections 230 are arranged to contact the outer periphery of the screw conveyor to cut up elongate waste material such as plastics bin liners and the like. This prevents such material from wrapping itself around the screw conveyor and causing it to jam. The projections 230 are provided with a cutting edge for this purpose. The outer periphery of the screw conveyor may also be provided with a sharpened edge to cut up the material. Where appropriate the ribs 22 are also able to provide a cutting surface or anvil against which the flight 24 of the screw conveyor 4 can act to break the waste material down into smaller pieces which are more easily compacted.

Figure 7:
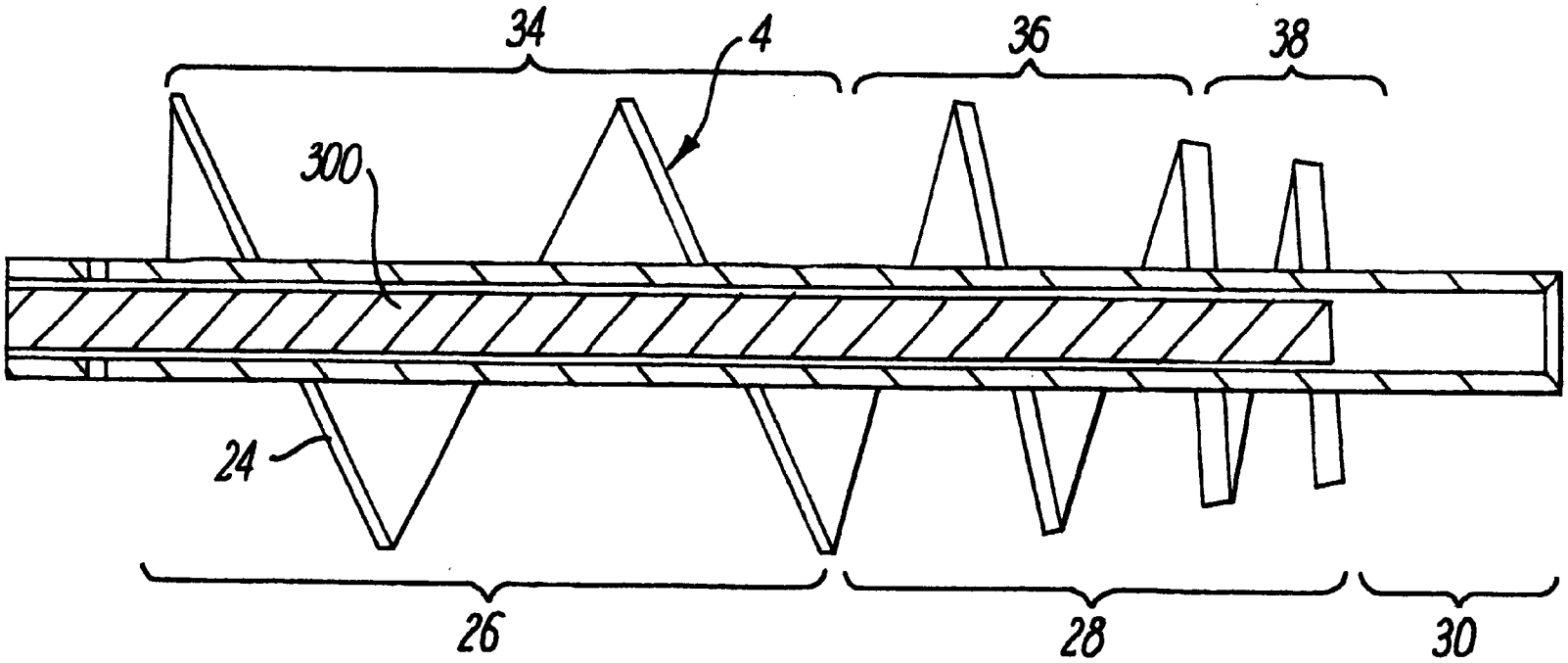
FIG. 7 shows a cross-sectional view of the screw conveyor of the compactor of FIG. 1.

The screw conveyor 4, which is illustrated in detail in FIG. 7 has a first part 26 where the flight is of uniform diameter. The length of this first part 26 corresponds substantially to the length of the first part 12 of the passage 6. The flight diameter of the second part 28 of the conveyor 4 decreases in a manner which corresponds generally to the degree of taper of part 20 of the passage 6. The diameter of the flight 24 of the screw conveyor is selected such that there is usually a few millimeters clearance between the screw conveyor 4 and the projecting ribs 22. Typically this clearance is in the range of 2 to 3 mm.

The screw conveyor 4 has a third part 30 in the form of a shank with no flight which extends into the nozzle 10. When the apparatus 2 is in use, the annulus of moving compacted waste material 65 in the compaction chamber 200 of the nozzle 10 acts as a bearing and supports the third part 20 i.e. the threadless axial shank of the screw conveyor 4. It has been found that the screw conveyor 4 is centered as well as supported by the waste material in the compaction chamber 200 so that the flight 24 no longer contacts the bottom 63 of the passage 6.

The pitch of the screw conveyor 4 also varies along its length. In particular the pitch of flight 24 decreases in the direction towards the second tapered part 28. The decrease in pitch of the screw conveyor 4 as well as the tapered of passage 6 enhances the degree of compaction achieved by the waste compaction apparatus 2. The pitch of the screw conveyor is of course selected depending on the material usually to be compacted as well as the degree of compaction required.

The thickness of the flight 24 changes along the length of the screw conveyor 4 and, in particular increases as the pitch decreases. Thus, the part of the flight which is subjected to the greatest force as a result of the tapering passage and reduced pitch, has the greatest thickness to withstand that increased force and the resulting increase in wear. The life of the screw conveyor 4 is thus increased. Likewise, those parts of the conveyor which are subjected to least force have the smallest flight thickness. This results in a useful reduction in the weight of screw conveyor especially since the part 34 of the flight 24 having the least thickness has the largest diameter. In practice, the thickness preferably begins to increase slightly upstream of the tapering part 28, although this is not appreciable from the drawings. The dimensions for pitch, flight thickness and flight diameter can all be varied in accordance with the application and size of the apparatus.

The screw conveyor 4 is made from any suitable material which has the desired strength, rigidity and resistance to wear for the particular application in question. For example the screw conveyor 4 may be of mild steel.

In accordance with the invention, the screw conveyor 4 is mounted to allow some degree of axial movement relative to the rest of the apparatus, while rotating. More specifically, the conveyor 4 is slidably mounted on a shaft 300, either by splines 301 as shown or by the shaft 300 having a non-circular cross-section, or similar. The shaft 300 extends out from the upstream end of the conveyor 4, by means of an extension 60, to a gearbox/bearing 69 through which the conveyor is driven by a drive motor 66. The shaft 300 therefore drives the conveyor 4 to rotate, while being able to move axially.

The screw conveyor 4 has a collar 225 against which a resilient bias means 302 acts. The bias means 302 is shown schematically as a compression spring acting between the collar 225 and the housing of the bearing 69 but it will be appreciated that many alternatives are possible, including compression or extension springs, hydraulic or other pressure arrangements to push on the screw conveyor 4, and others. Alternatively, the conveyor 4 could be fixed to the shaft 300, with the entire shaft and conveyor being movable axially relative to the hopper 16.

The spring 302 acts to push the conveyor 4 forwards, i.e. toward the nozzle 10. This causes the tapering part 36,38 to come into closest adjacency with the tapering second part 20 of the passage but if the conveyor 4 moves axially away from the nozzle 10, the separation between the flight 24 and the second part 20 would increase by virtue of the tapers of both. This allows blockages to be simply removed or avoided, in a manner which will be described in more detail below. It can be seen from the drawings that in this example, both tapers are substantially to the same degree but could be different.

It will be apparent to the skilled man that as the conveyor 4 slides along the shaft 300, some provision may be required to prevent waste material being compacted into gaps formed as the conveyor moves, which might prevent the conveyor moving back again. Appropriate sheaths or gaskets could be used, or the various components could comprise telescoping shields which ride over each other and deflect waste material away from the central axis, to prevent fouling.

Figure 2:
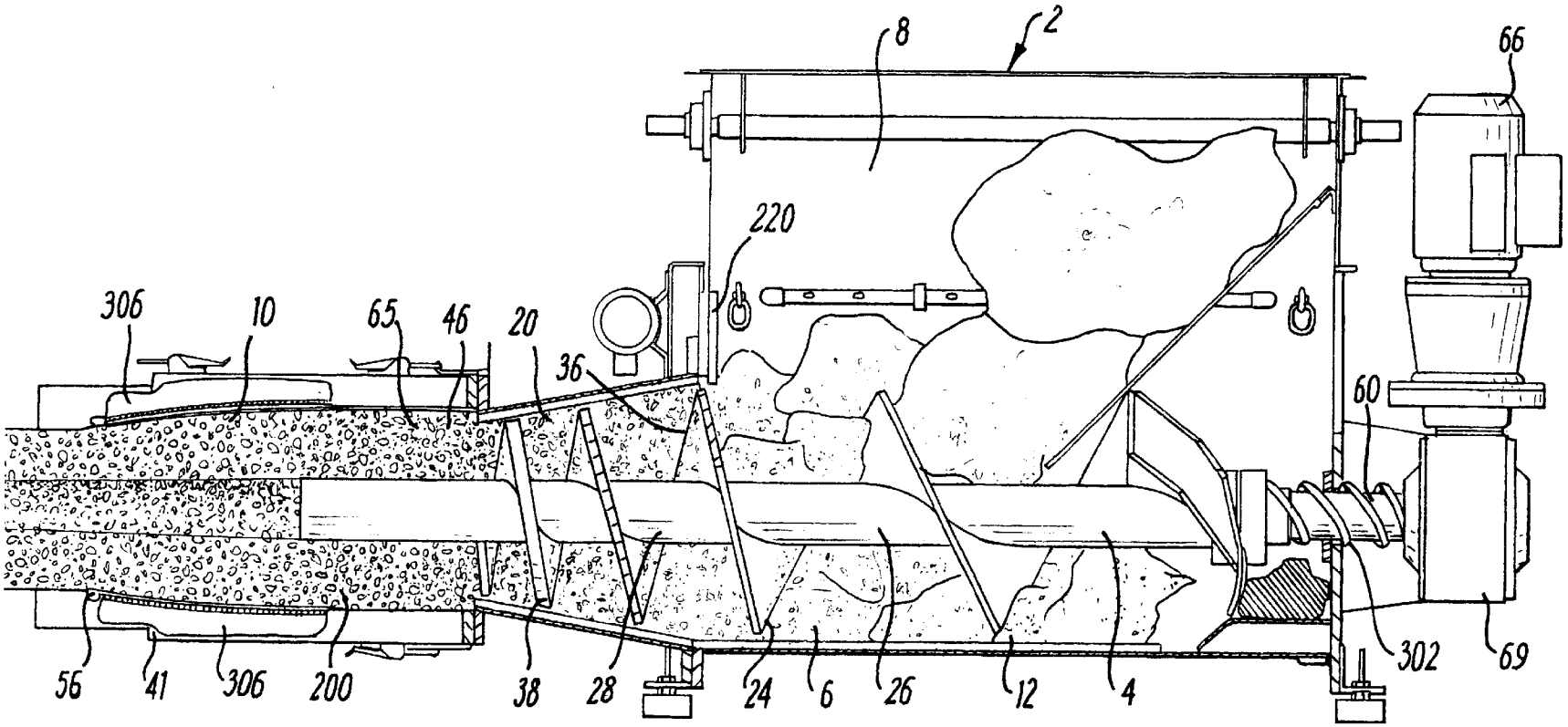
FIG. 2 shows a longitudinal cross-sectional view of the compactor of FIG. 1 when filled with waste material.

FIGS. 1 and 2 also show an adjustable cutting plate 220 having a cutting edge adjacent the screw at the beginning of its tapering portion. A cooperating cutting edge is formed along the outer edge of the conveyor flight in the tapering part 36,38 of the conveyor, as indicated at 304, which shows a serrated edge extending around substantially one complete turn of the screw. The blades 220,304 cooperate together to cut up long items such as wooden poles and the like as they pass through the apparatus and also to serrate large, bulky or incompressible items, to help prevent blockages. The provision of the edge 304 along a significant length of the screw 4 ensures that the blades 220,304 can cooperate over substantially the whole range of axial positions likely to be occupied by the screw conveyor 4 during use. However, it will be apparent that by virtue of the taper on the conveyor 4, the separation of the blades 220,304 will vary as the conveyor 4 moves backward and forward along the shaft 300.

Figure 4:
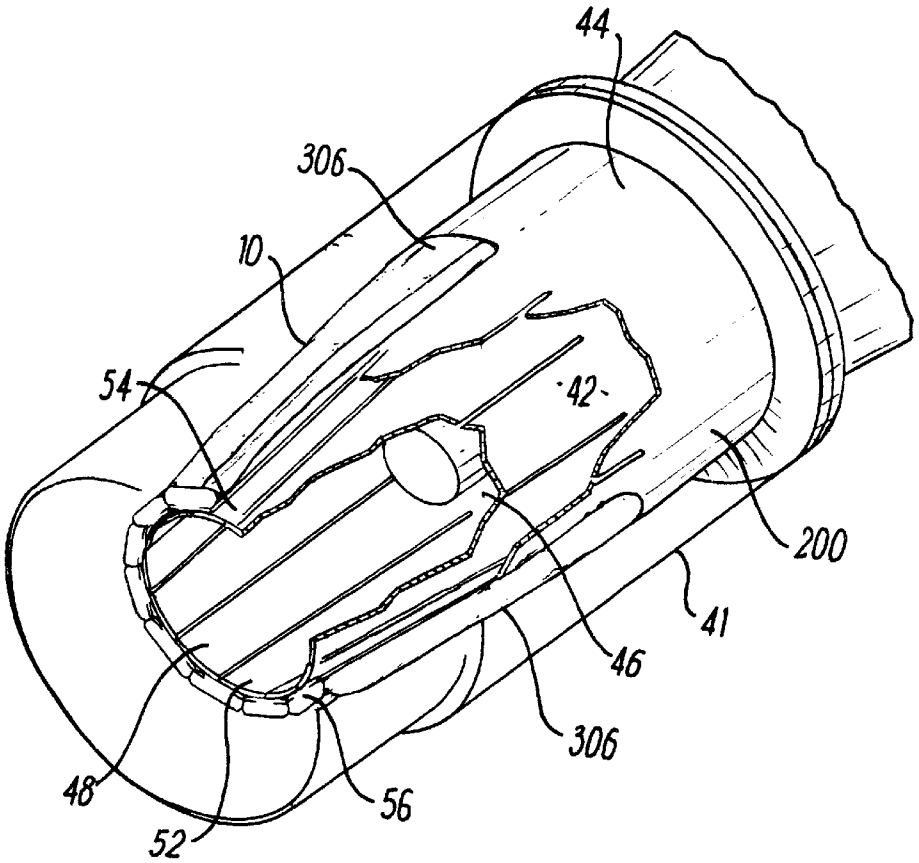
FIG. 4 shows a perspective view of the nozzle of FIG. 1 which has been partially cut away for clarity.
Figure 3:
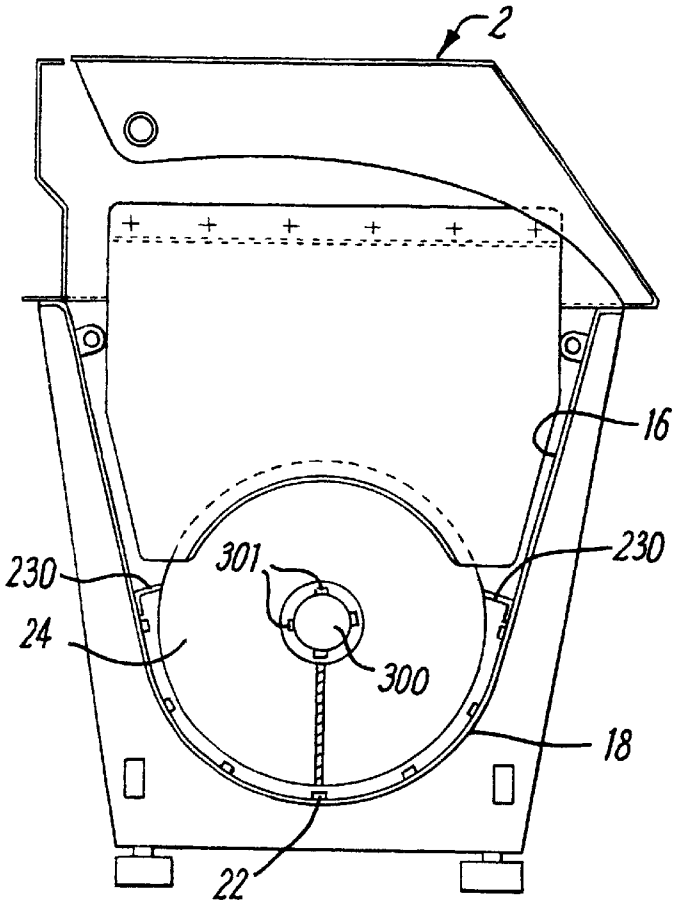
FIG. 3 shows a cross-section of the compactor of FIG. 1 along line III—III.
Figure 5:
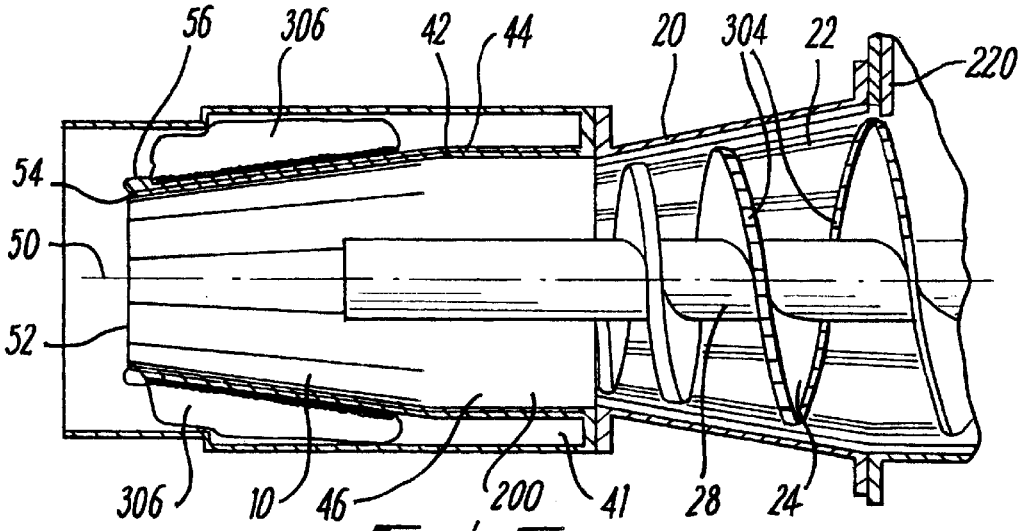
FIG. 5 shows a cross-sectional view of the output end of the compactor of FIG. 1, with the screw conveyor packaged for transportation.
Figure 6:
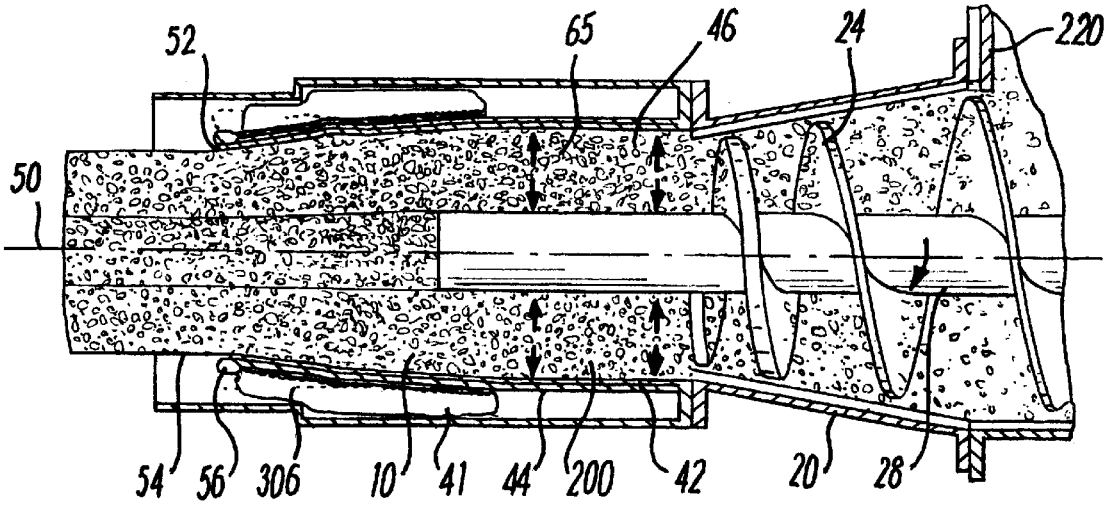
FIG. 6 shows a cross-section view of the output end of the compactor of FIG. 1, when filled with waste material.

The nozzle 10 will now be described in more detail with particular reference to FIGS. 4, 5 and 6. The nozzle 10 is coupled to the outlet end of passage 6 at the end of section 20 and is surrounded by chamber 41 which allows any material leaking from the nozzle 10 to be collected in the chamber 41. The nozzle is made up of two main parts 42 and 44. The first part 42 is formed from a sheet of material such as a sheet steel with a thickness of 2 to 3 mm which has been rolled up to form a cylinder and welded to maintain that shape. The base portion 46 of the first part 42, which is connected to the passageway 6, is circular, of substantially constant cross-section and of unbroken sheet material. This defines a compaction chamber 200 in which further substantial compaction of the waste material takes place upstream of the tapering portion of the nozzle. From this base portion 46 a plurality of e.g. twelve fingers 48 extend, the axis of each finger initially being generally parallel to the longitudinal axis 50 of the nozzle 10. The width of each finger 48 decreases in the direction towards the outlet 52 of the nozzle 10 to thereby define V-shaped gaps (not shown) between adjacent fingers 48.

The second part 44 is constructed in a similar manner to the first part 42, the two parts differing only in dimensions. In particular the second part 44 is slightly longer than the first part 42 and has a slightly larger diameter. The first part 42 is arranged inside the second with the base portions 46 of the first and second parts 44 and 44 being welded together. The two parts 42 and 44 are arranged so that the fingers 48 of tone part overlap the gaps between the fingers of the other part i.e. each finger of one part overlaps two fingers of the other part.

On the outer surface of the ends 54 of each of the fingers 48 of the second outer part 44, a lug 56 is provided. These lugs 56 extend in a generally outward direction. An inflatable member 306 of rubber, rubberised or other inflatable material surrounds the outer part 44 over at least part of the length of the fingers. The lugs 56 help retain the inflatable "spring" 306 in position around the nozzle. The inflatable spring 306 fills a gap between the fingers and the walls of the chamber 41, and provides resilient bias to the fingers of the first and second parts, to bias them to their smallest position (i.e. the position in which they define the smallest nozzle aperture). However, as the pressure and/or volume of waste material passing through the nozzle 10 increases, the cross-sectional area of the nozzle 10 can increase, for example as shown in FIG. 6, against the resilience of the spring 306. In this instance, the inward force exerted by the spring 306 (reacting on the walls 41) is exceeded by the outward force exerted by the fingers 48 as a result of the waste material, and a new equilibrium position is therefore established. Thus, the tapering portion of the nozzle 10 regulates its size in response to variations in the pressure and volume of material passing through the nozzle and other operating conditions, and an appropriate back pressure can be provided for satisfactory compaction over a range of operating conditions. The equilibrium position which is occupied will be determined in part by the resilience of the spring 306, which in turn is set by the degree of inflation. As the spring 306 is further inflated, it becomes harder and therefore more strongly resilient, tending to hold the nozzle more tightly with the fingers closer together. As the degree of inflation is reduced, the fingers are held more softly and the nozzle will tend to be wider for a given set of operating conditions.

The general operation of the apparatus will now be described with particular reference to FIGS. 2 to 6. First, material is inserted into the hopper 16. The operator then starts the motor 66 to rotate the screw conveyor 4. Initial compaction takes place in the tapering portion of the screw, as described above. More substantial compaction will then take place in the compaction chamber 200, downstream of the end of the screw conveyor flight, between the flight and nozzle 10. This is due to the back pressure established by the nozzle 10, under the variable influence of the inflatable spring 306. The action of the screw is to force material from a lower pressure upstream region under the hopper, to a higher pressure region in the chamber 200. It does this by sweeping out a void space trailing a blunt free end of the screw, which space is then filled by new material moving from the hopper to fill the void. Material in the high pressure region eventually collapses (is compacted) to become stable.

In the event that the compaction process becomes blocked for any reason, such as an incompressible or oversized object, the torque required to continue turning the conveyor will increase and the thrust required to maintain the conveyor at a particular axial position will also increase. However, the sliding mounting arrangement of the conveyor 4 allows the conveyor 4 to move back from the nozzle when the back thrust is sufficient to exceed the bias provided by the spring 302. As that happens, the gap between the conveyor and the tapering section 20 increases, as has bene described. Eventually, a new equilibrium position will be reached, in balance between the spring thrust and the back thrust. This may be sufficient to allow the cause of the blockage to pass through to the final compaction chamber 200, thereby clearing the blockage. Similarly, if the blades 220,304 are cutting or chopping material while the conveyor is in the forward position, but an oversize element cannot fit between the cutting blades, the conveyor can be forced back against the spring 302 until either the article is accommodated between the blades, so clearing the blockage, or the cutting force between the blades increases (by virtue of the spring bias) to a degree at which the article is finally cut.

This ability of the conveyor to be interactive to react to blockages and move to help clear them results in a compaction apparatus which can work more reliably with a wide range of materials and in a wide range of operating conditions, without requiring other, more complex arrangements for clearing blockages. The apparatus operates in a different manner to the earlier apparatus described in the above-mentioned PCT application, in that the present apparatus will reset itself to allow blocking material to pass through (at least on some occasions), rather than withdrawing the blocking material and repeatedly presenting it until it is compacted or chopped in the intended fashion.

Figure 8:
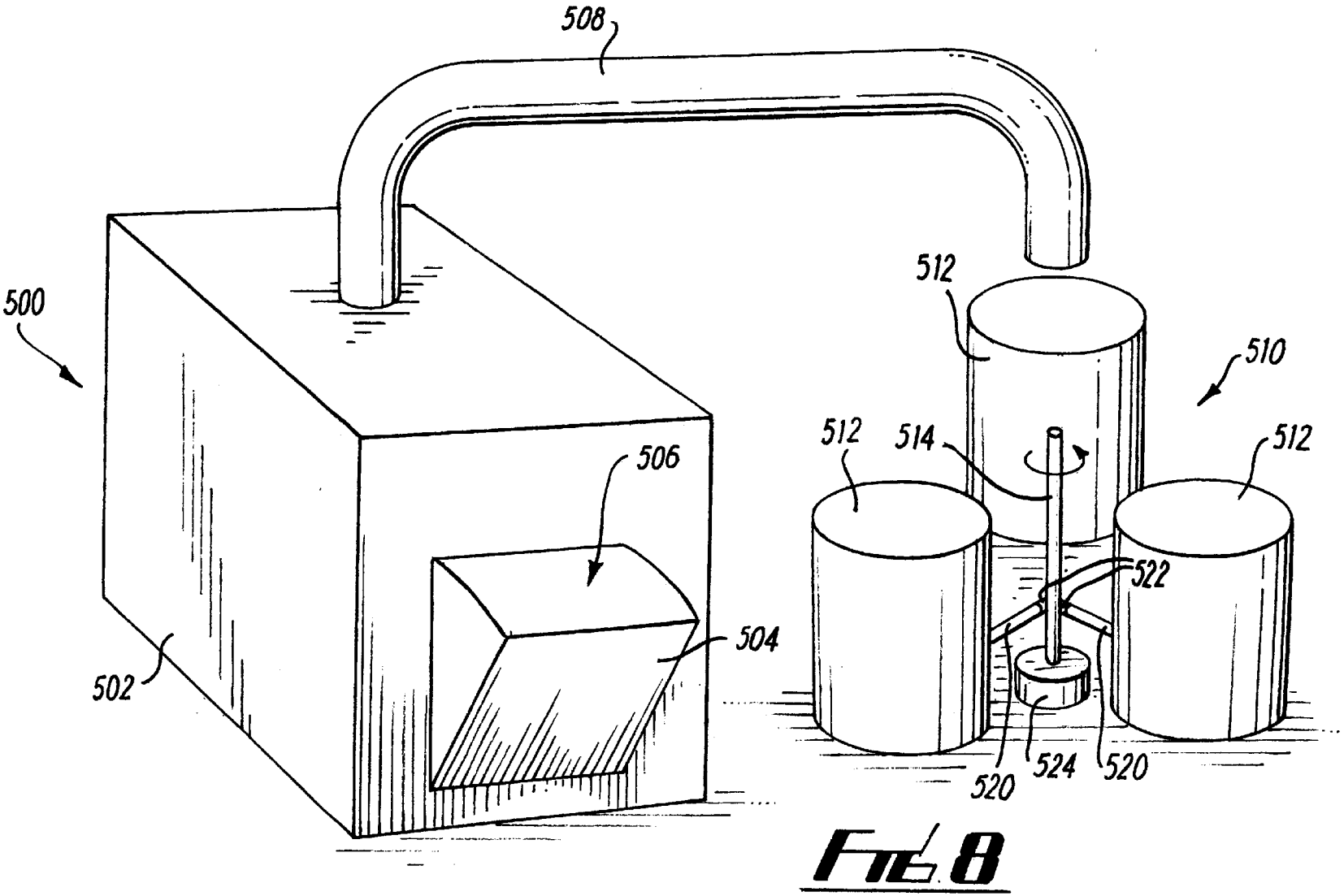
FIG. 8 is a highly schematic perspective view indicating one application of apparatus according to the present invention.

FIG. 8 shows an application for a compactor of the type described, particularly a small version having a hopper volume of approximately 0.1 and 0.4 $mm^3$. In FIG. 8, a compactor 500 generally as described above is arranged within an aesthetically pleasing housing 502 and with the axis inclined upwardly, perhaps even vertical. A door 504 may swing down to allow material to be introduced into the hopper through an opening 506. The compactor then forces this material up, compacting it as it does so, into a pipe 508 which connects the compactor 500 to a collection arrangement at 510.

The collection arrangement, which may be housed in a second aesthetic housing (not shown) which matches the housing 502, incorporates a carousel having three collection locations 512 in the example shown. These locations 512 are equally spaced around a vertical central axis 514 and each consists of a basket which can hold a refuse bag or sack. Each basket 516 is supported on the axis 514 by an arm 520. A sensor 522 associated with each arm 520 monitors the weight of the basket 516 and its contents. When the weight exceeds a threshold, an instruction is sent to a drive arrangements 524 to rotate the axis 514 to bring a second, empty basket 516 to the collection position underneath the outlet of the pipe 508. Having moved away from the collection position, the full basket can then be emptied while the fresh, empty basket is still receiving material through the pipe 508. It may be desirable to allow all except one of the baskets to be accessed for emptying, or to provide a single emptying location from which baskets may be emptied as they move to that location.

It is preferred that the compactor operates vertically or in an inclined direction as described, to minimise the floor space occupied by the apparatus. Furthermore, the collection arrangement 510 allows material to be automatically packaged into a conveniently handleable form, for instance for manual handling. The sensor arrangement ensures that safety requirements are not exceeded, by preventing baskets from becoming too heavy.

It will be apparent that very many variations and modifications from the apparatus described above can be made without departing from the scope of the present invention. In particular, the form and geometry of the hopper, conveyor and compacting chambers described can be widely varied, as can be the manner of mounting the conveyor for axial movement. Many alternative designs of carousel could be designed for the apparatus of FIG. 8 and the compactor may require some variation from the designs shown in other figures in order to operate with a vertical rotation axis.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. Compacting apparatus comprising a screw conveyor for conveying waste material through a passage and compacting it therein, an exit nozzle communicating with the passage, the nozzle defining an internal transverse cross-sectional area which enlarges and reduces and which comprises at least one selectively variable and adjustable resilient member which sets the nozzle to be biased towards and maintains a specifically desired cross-sectional area within its range of enlargement or reduction to achieve compaction substantially independent of increasing and decreasing waste material pressure.

2. Apparatus according to claim 1, in which the or at least one resilient member comprises an inflatable portion which provides an adjustable degree of resilience dependent upon the degree of inflation of the resilient portion.

3. Apparatus according to claim 1, in which the nozzle has a plurality of wall portions which are movable relative to each other to vary the cross-sectional area of the nozzle, the resilient member cooperating with the wall portions to bias the nozzle toward a position of minimum cross-sectional area.

4. Apparatus according to claim 1, in which the nozzle comprises a number of spaced apart, longitudinally extending fingers.

5. Apparatus according to claim 4, in which there are no gaps between the fingers.

6. Apparatus according to claim 1, in which the nozzle tapers towards its outlet when the nozzle cross-sectional area is at its minimum.

7. Apparatus according to claim 1, in which the nozzle comprises two members each of which has a number of spaced apart, longitudinally extending fingers, one member being arranged inside the other.

8. Apparatus according to claim 7, in which the resilient member is located to surround an outer of the two members to provide resilient bias thereto.

9. Apparatus according to claim 7, in which the two members are arranged such that a finger of one member overlaps two fingers of the other member whereby there are substantially no gaps between the fingers.

10. Apparatus according to claim 1 and further comprising collection means, to which compaction material is delivered, in use, the collection means providing a plurality of locations at which compacted material may be received, and being movable to allow one location to move to an emptying position while another is moving to a position for receiving material from the compacting means.

11. Apparatus according to claim 10, in which the collecting means comprises a rotatable carousel.

12. Apparatus according to claim 10, in which each location is adapted to removably receive a receptacle which can be removed when full for replacement by an empty receptacle.

13. Apparatus according to claim 12, in which the receptacle is a bag or bin liner.

14. Apparatus according to claim 10, in which the apparatus comprises means operable to detect the weight of material received at a location and to cause the collection means to move when the received weight exceeds a threshold value.

15. Apparatus according to claim 10, in which the screw conveyor has a substantially vertical orientation to drive compacted material up to a position from which the material may fall to the collection means.

* * * * *